United States Patent [19]

Pangborn

[11] 4,181,585

[45] Jan. 1, 1980

[54] ELECTRODE AND METHOD OF PRODUCING SAME

[75] Inventor: Robert J. Pangborn, Midland, Mich.

[73] Assignee: The Dow Chemical Company, Midland, Mich.

[21] Appl. No.: 921,688

[22] Filed: Jul. 3, 1978

[51] Int. Cl.[2] ..... C25B 1/16; C25B 1/26; C25B 11/10; C25B 11/12

[52] U.S. Cl. ..... 204/98; 204/128; 204/242; 204/290 R; 204/290 F; 204/294; 427/423

[58] Field of Search ..... 204/290 R, 290 F, 98, 204/128, 242, 294; 427/423

[56] References Cited

U.S. PATENT DOCUMENTS

| | | | |
|---|---|---|---|
| 3,437,579 | 4/1969 | Smith | 204/294 |
| 3,489,668 | 1/1970 | Anton et al. | 204/294 |
| 3,770,613 | 11/1973 | Chisholm | 204/290 R |
| 3,876,520 | 4/1975 | Blue et al. | 204/266 |
| 3,977,958 | 8/1976 | Caldwell et al. | 204/252 |
| 4,035,254 | 7/1977 | Gritzner | 204/98 |
| 4,035,255 | 7/1977 | Gritzner | 204/98 |
| 4,061,549 | 12/1977 | Hazelrigg et al. | 204/98 |

FOREIGN PATENT DOCUMENTS

| | | | |
|---|---|---|---|
| 1286513 | 1/1969 | Fed. Rep. of Germany | 204/290 F |
| 1467226 | 6/1970 | Fed. Rep. of Germany | 204/290 F |
| 921688 | 10/1974 | Fed. Rep. of Germany . | |
| 4814311 | 5/1973 | Japan | 204/290 F |
| 1147442 | 4/1969 | United Kingdom | 204/290 F |
| 1468670 | 3/1977 | United Kingdom . | |

*Primary Examiner*—R. L. Andrews
*Attorney, Agent, or Firm*—James M. Kuszaj; Robert W. Selby

[57] ABSTRACT

An electrode suitable for use in an electrolytic cell is dissolved. The electrode comprises: an electroconductive substrate with at least a portion of the surface thereof being a solderable metal. The electroconductive substrate abuttingly joins a film-forming metal by means of an electrically conductive, fused, non-ferrous bonding layer interposed between the solderable metal surface of the substrate and the inner surface of the film-forming metal. At least a portion of the inner surface of the film-forming metal is a solderable metal. At least a portion of the outer surface of the film-forming metal is electrocatalytically active and corresponds at least partially to the working area of the electrode. A method of producing the electrode, and its use as an anode in the electrolytic production of chlorine are also disclosed.

18 Claims, 2 Drawing Figures

ELECTRODE AND METHOD OF PRODUCING SAME

BACKGROUND OF THE INVENTION

The present invention relates to an electrode, a method of producing the electrode, and to an improved process and cell for electrolyzing an aqueous alkali metal chloride electrolyte by use of the electrode.

In the past, electrodes for the electrolysis of alkali metal brines, whether for the production of chlorine or alkali metal chlorate, generally have been bulk graphite slab or plates. The problems associated with the use of graphite electrodes in such applications are well known to practitioners in the art. The products of the electrolysis reaction tend to chemically and physically attack the surface of the graphite. As the graphite wears away, the distance between electrodes increases, thus causing an increase in energy consumption of the electrolytic cell. Furthermore, the chemical and physical deterioration of the graphite produces undesirable carbon products within the cell.

There have been numerous attempts to improve the dimensional stability of graphite electrodes. For this purpose, the graphite has been coated with various substances in an attempt to improve its resistance to chemical, physical and electrochemical attack. Catalytically effective coatings have also been applied to the graphite with the intention of increasing power efficiency. However, such coatings themselves tend to erode over extended periods of time.

Another approach that has been adopted in the art to achieve dimensional stability is to replace the graphite with metallic electrodes. In their common form, such metallic electrodes have a film-forming metal base coated with an electrocatalytically active material, usually a noble metal or oxide of a noble metal. Film-forming metal bases that have been suggested include: titanium, tantalum, tungsten, niobium, zirconium, and alloys thereof. The most frequently used film-forming metal base has been titanium. However, in many applications solid metallic electrodes may not be economically attractive for commercial use due to the large amounts of high cost film-forming metals, noble metals, and noble metal oxides that are required.

Another approach that has been adopted in the art to achieve dimensional stability is to coat a graphite substrate with a film-forming metal, and then apply an electrocatalytically active material to the film-forming metal. See for example, U.S. Pat. No. 3,770,613. However, the known methods of joining the graphite substrate to the film-forming metal create an undesirable voltage drop across the interface between the graphite and the film-forming metal.

Consequently, there is a need for an electrode which is relatively inexpensive, energy efficient, resistant to chemical, physical, or electrochemical attack, dimensionally stable, and resistant to voltage drops across its surface.

SUMMARY OF THE INVENTION

An electrode having the above described desired characteristics has now been discovered.

The electrode comprises: an electroconductive substrate with at least a portion of the surface thereof being a solderable metal; the electroconductive substrate being abuttingly joined to a film-forming metal by means of an electrically conductive, fused, non-ferrous bonding layer interposed between the solderable metal surface of the substrate and the inner surface of the film-forming metal; the film-forming metal with at least a portion of the inner surface thereof being a solderable metal, the outer surface of the film-forming metal corresponds to at least a portion of the working area of the electrode, at least a portion of the outer surface being electrocatalytically active.

The electrode is produced by interposing a non-ferrous filler layer between the solderable metal surfaces of the electroconductive substrate and the film-forming metal. At least a portion of the outer surface of the film-forming metal is electrocatalytically active or is capable of being rendered electrocatalytically active and corresponds to at least a portion of the working area of the electrode. At least the non-ferrous filler layer is heated to sufficient temperature to effect an electrically conductive bond between the solderable metal surfaces.

In one embodiment, the electrode is produced by applying the solderable metal to at least a portion of the surface of the electroconductive substrate. A solderable metal is also applied to at least a portion of the inner surface of the film-forming metal. The outer surface of the film-forming metal corresponds to at least a portion of the working area of the electrode and at least a portion of the outer surface is electrocatalytically active or is capable of being rendered electrocatalytically active. The non-ferrous filler layer is interposed between the surfaces of the substrate and the film-forming metal having the solderable metal applied thereto. Finally, at least the non-ferrous filler layer is heated to a sufficient temperature to effect an electrolytically conductive bond between the solderable metals.

The present invention also relates to an improvement in an electrolytic cell and to an improved process for electrolyzing an aqueous alkali metal electrolyte. The process involves passing a direct electric current through the electrolyte and between a cathode and an anode. The improvement comprises the use of the electrode described above as the anode.

DESCRIPTION OF THE DRAWINGS

The accompanying drawing further illustrates the invention.

Identical numbers, distinguished by letter suffix, within the several figures represent parts having similar function within the different embodiments. The exact proportion between components has been exaggerated for purposes of clarity.

DETAILED DESCRIPTION OF THE INVENTION

Figure 1:
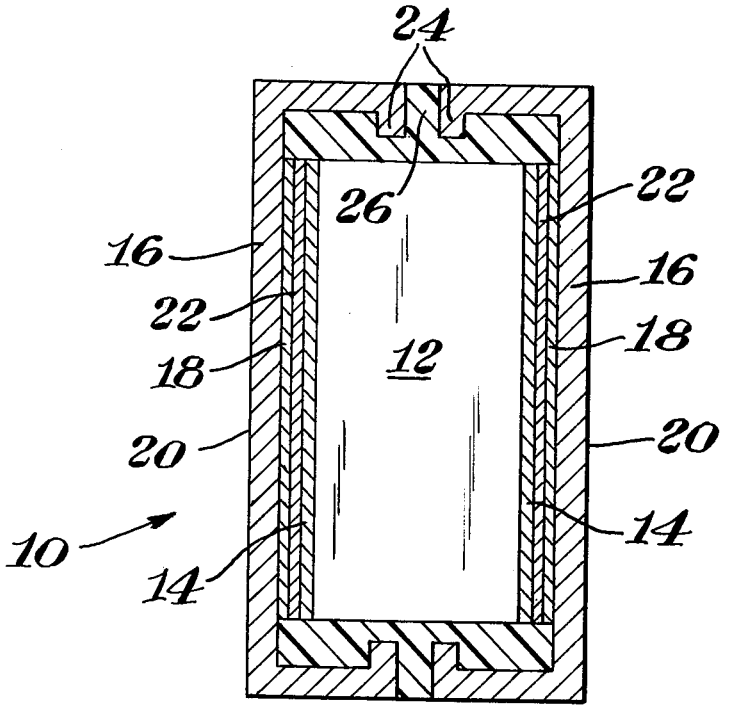
FIG. 1 is a cross-sectional side view of one embodiment of the electrode of the invention.

Referring now to the embodiment of the invention illustrated in FIG. 1, there is depicted an electrode in accordance with the present invention generally designated by reference numeral 10. Electrode 10 comprises an electroconductive substrate 12 with at least a portion of its surface being a solderable metal 14. A film-forming metal 16 (as defined herein below) is also provided. The film-forming metal 16 has at least a portion of its inner surface being a solderable metal 18. The outer surface 20 of the film-forming metal corresponds, at least in part, to the working area of the electrode and is electrocatalytically active.

The electroconductive substrate 12 is abuttingly joined to the film-forming metal 16 by means of an electrolytically conductive, fused, non-ferrous bonding layer 22 interposed between the solderable metal surfaces 14 and 18.

The electroconductive substrate 12 is sealed at its edges from the environment by inwardly extending portions 24 of film-forming metal 16. A chemically resistant material 26 is interposed between the electroconductive substrate 12 and the inwardly extending portions 24 of the film-forming metal 16.

Figure 2:
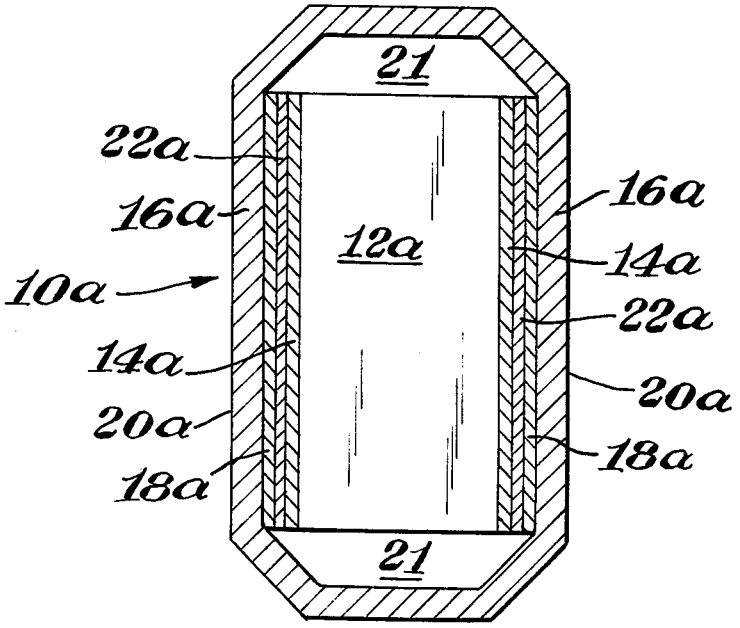
FIG. 2 is a cross-sectional side view of another embodiment of the electrode of the invention.

Referring now to the embodiment of the invention illustrated in FIG. 2, the electrode 10*a* is similar to the electrode of FIG. 1 except that the electroconductive substrate 12*a* is sealed at its edges from the environment by extending the film-forming metal 16*a* so as to form a sealed envelope type structure.

The electrodes are shown in the Figures as having a substantially rectangular structure, but it will be understood that the electrode is not limited to such configuration and may have any configuration suitable for its intended end use.

The electroconductive substrate is constructed of a conductive material which is itself solderable or which is capable of retaining a solderable base metal coating on its surface. Illustrative of suitable electroconductive substrates are, for example, film-forming metals, such as magnesium, copper, titanium, tantalum, zirconium, niobium, tungsten, bismuth, aluminum, and alloys containing such metals. Since the electroconductive substrates will generally not be in direct contact with corrosive materials, (e.g., the electrolytic products and electrolyte of an electrolytic cell) the electroconductive substrate may also be formed of other suitable metals such as, for example, iron, nickel, or lead. Non-metallic conductive materials, such as graphite, are also suitable. In at least one embodiment of the present invention, the electroconductive substrate is preferably graphite.

At least that portion of the surface of the electroconductive substrate which corresponds in area to at least a portion and preferably substantially all of the working surface of the electrode is composed of the solderable metal. As used herein, the term solderable metal denotes any metal which is capable of being joined to itself or to another metal by use of a metallic alloy fused by conventional soldering and/or brazing techniques. Illustrative of suitable solderable metals are iron, copper, nickel, lead, tin, zinc, silver, gold, magnesium, aluminum, and alloys thereof. The preferred solderable base metal is copper.

The film-forming metals of the invention are metals selected from the group consisting of titanium, tantalum, zirconium, molybdenum, niobium, hafnium, vanadium, tungsten, bismuth, aluminum, and alloys containing such metals. The preferred film-forming metal is titanium.

The outer surface of the film-forming metal corresponds at least in part to the working area of the electrode and is at least partially electrocatalytically active. By the term "electrocatalytically active" is meant that the material is capable of protecting the film-forming metal from developing a passivating film, and is also capable of conducting current from the film-forming metal to an electrolyte when the electrode is employed in an electrolytic cell. Moreover, the material should be capable of catalyzing the formation of chlorine molecules at the electrode during electrolysis of an alkali metal chloride. A large number of electrocatalytically active materials are known in the art. Illustrative examples of suitable electrocatalytically active material include platinum, iridium, osmium, palladium, rhodium, ruthenium, cobalt, alloys thereof, compounds containing such material, and especially the oxides of such materials. A preferred electrocatalytically active material is the bimetallic oxide containing cobalt described in U.S. Pat. No. 4,061,549.

The electrocatalytically active surface of the film-forming metal need not cover the entire surface of the electrode. As is well known in the art, the coating need only cover a portion of the surface of the film-forming metal to be effective.

The inner surface of the film-forming metal is itself solderable or is coated with a solderable metal. Any of the solderable metals mentioned above can be used. Preferably, the solderable metal of the electroconductive substrate and the film-forming metal are substantially the same.

The electroconductive substrate is abuttingly joined to the film-forming metal by means of an electrically conductive bonding layer of a fused non-ferrous filler metal interposed between solderable metal surfaces of the substrate and the film-forming metal.

The non-ferrous filler metal layer can be any material which is capable of adhering to the solderable metal surfaces of the film-forming metal and the electroconductive substrate in a manner relatively permanent under conditions obtained during use. Illustrative of suitable non-ferrous filler metals are, for example, the alloys of lead, tin, silver, bismuth, antimony, copper, zinc, and cadmium. The preferred non-ferrous filler metal from an economic viewpoint is an alloy of tin and lead.

In one embodiment, the electrode of the invention is conveniently produced by first applying the solderable metal to at least a portion of that surface of the electroconductive substrate that corresponds to the working area of the electrode. The solderable metal can be applied by any of the well known techniques for applying metals to electroconductive substrates. For example, the solderable metal can be applied to the substrate by spraying the metal in molten form, by electroplating, or the like. The preferred method of applying the solderable metal to the substrate is flame spraying the solderable metal onto the electroconductive substrate. In one embodiment of this technique, a wire of the metal to be applied to the substrate is inserted into an oxyacetylene flame at a sufficient speed to melt the metal. An air current then propels the molten metal against the surface of the substrate with a sufficient velocity to cause the metal to adhere to the surface of the substrate. Generally the adhering solderable metal layer is from about 100 to about 400 microns in thickness. However, if desired, greater or lesser thicknesses can be employed.

In a similar manner to that described above, the solderable metal is applied to at least a portion of the inner surface of the film-forming metal.

Because film-forming metals have the tendency to form an oxide coating on their surfaces, the inner surface receiving the solderable metal is generally cleaned. Well-known cleaning techniques such as, for example, the use of an abrasive, are employed to render at least a portion of the metal surface receptive to the solderable metal. In many applications, the electroconductive substrate can also advantageously be cleaned with a suitable abrasive or reagent.

The non-ferrous filler metal layer is then interposed between the solderable metal surface of the electroconductive substrate and the solderable metal surface of the film-forming metal. The film-forming metal, the non-ferrous filler metal layer, and the electroconductive substrate are then joined together, for example, by a clamp. Sufficient heat is applied to cause the fusion of the non-ferrous filler metal layer and the corresponding bonding of the solderable metals together. Preferably, the fusion is brought about by heating the joined components to a temperature above the melting point of the non-ferrous filler layer, and below the melting point of the solderable metals. For example, where the substrate is graphite, the film-forming metal titanium, the solderable base metal copper, and the non-ferrous filler metal a 50/50 alloy of tin and lead, the materials are joined at a temperature of from about 430° to about 500° F.

The preliminary joining step and the subsequent heating step can be performed by any of the methods well known in the art. For example, in the specific embodiment outlined above, the titanium, the tin/lead alloy solder and the graphite substrate were pressed between iron plates and heated to about 450° F., to form a bonded composite electrode.

The outer surface of the film-forming metal is electrocatalytically active. The electrocatalytically active material can be present on the film-forming metal during the joining steps described above or it can be formed following the joining steps by well-known techniques.

Generally, it is desirable to render the entire electrode substantially fluid impervious. Since the film-forming metal applied to the electroconductive substrate generally has dimensions which exceed those of the working surface substrate, it is preferred to overlap the edges of the substrate with the film-forming metal and employ the excess film-forming metal as a fluid impervious barrier to the environment. This may be done in a number of ways. For example, in the embodiment of FIG. 1, the film-forming metal is bent over the edges of the electroconductive substrate. The resulting cavity formed thereby is filled with a chemically resistant material, for example, a vinyl ester resin. In the embodiment shown in FIG. 2, the film-forming metal is constructed in the form of a sleeve which fits over the electroconductive substrate and then sealed at the top and bottom edges by laser or other suitable welding techniques.

The electrode of the invention is useful in electrolytic processes, particularly in the electrolytic production of chlorine. However, the electrode is also useful in any electrolytic operation where dimensional stability is a desired property. Illustrative of other applications for the present electrode are: the electrolytic production of chlorates, hypochlorites, persulfates, perborates; the oxidation of organic compounds; desalination and purification of water; galvanic processes; cathodic protection systems; and the like.

The manner in which the electrode is used as an anode for electrolyzing an aqueous alkali chloride electrolyte to form chlorine, hydrogen, and an alkali metal hydroxide will be readily apparent to those skilled in the art.

Typically, the electrolytic cell comprises an anode chamber and a cathode chamber. The anode chamber is suited to contain an anolyte such as an aqueous solution or mixture of an alkali metal chloride, for example, sodium chloride. The cathode chamber is adapted to contain a catholyte such as the hydroxide of the alkali metal. The anode chamber is separated from the cathode chamber by a cation-permeable partition, such as a diaphragm or membrane. The anode is suitably positioned within the anode chamber and the cathode is suitably positioned within the cathode chamber. The alkali chloride electrolyte is introduced into the anode chamber, and at least a portion of the alkali metal ions pass through the partition into the cathode chamber. Sufficient amounts of a direct electrical current are then supplied to the anode and cathode to release gaseous chlorine at the anode and to form the alkali metal hydroxide in the cathode chamber. Detailed descriptions of typical cells in which the electrode may be used are found in U.S. Pat. Nos. 4,061,549; 4,035,255; 4,035,254; and 3,876,520, all of which are incorporated herein by reference.

The following examples further illustrate the invention:

Example 1—Preparation of the Electrode

Two titanium sheets approximately 6×16×0.003 inches, were cleaned by grit blasting with 46 mesh (U.S. Standard Sieve Series) alumina ($Al_2O_3$) grit. The sheets were then coated with a solid solution of ruthenium and titanium oxide in a manner substantially as described in Example 1 of a commonly owned, copending patent application Ser. No. 787,418, filed Apr. 14, 1977, now U.S. Pat. No. 4,112,140 issued Sept. 5, 1978, which application is incorporated herein by reference.

The sides of the titanium sheets not coated with ruthenium and titanium oxide were cleaned with an emery cloth to remove any titanium dioxide formed by air oxidation of the exposed titanium metal surface. A coating of copper metal was applied to the thus cleaned surfaces by metal spraying. In this method, a ⅛ inch diameter copper wire was fed into an oxyacetylene flame at a speed just sufficient to permit melting of the copper. The molten copper was atomized and projected against the surface of the titanium. The impingement of the copper particles on the surface of the titanium formed a continuous coating of copper approximately 400 microns thick.

Both faces of a piece of graphite approximately 5×15×1.2 inches were copper sprayed by the method described above. The copper coating on the graphite faces was approximately 400 microns thick.

A solder containing 50 parts by weight tin and 50 parts by weight lead was placed on the copper-coated faces of the graphite. One of the titanium sheets was placed against each of the faces of the graphite, so that the copper coated surface of each titanium sheet was also in contact with the solder. That portion of each titanium sheet extending beyond the edges of the graphite was bent inwardly. The titanium sheets, solder, and graphite were then pressed together between heated plates at about 450° F. The cavity formed between the graphite and the inwardly extending edges of the titanium was filled with a vinyl ester resin. The resin was cured at 70° C. for about 72 hours. The resulting composite electrode was allowed to cool slowly while still under pressure, and the pressure was then released.

Example 2—Use of the Electrode in an Electrolytic Cell

The electrode produced in Example 1 is employed as an anode in a laboratory electrolytic cell to produce gaseous chlorine from an aqueous solution containing about 300 grams per liter sodium chloride. The anode is suitably spaced apart from a steel screen cathode by an asbestos containing diaphragm. The cell is operated at an anode current density of 1.0 amp per square inch and a voltage of 3.5 volts. The sodium hydroxide concentration in the catholyte is about 140 grams per liter and the pH of the anolyte is from about 2.0 to about 4.5. The cell is operated at a temperature of from about 75° to about 85° C. Substantially no carbon dioxide from chemical attack of the graphite anode is formed during operation.

Example 3

The electrode produced in Example 1 is employed as an anode in a laboratory electrolytic cell to produce gaseous chlorine from an aqueous solution containing about 300 grams per liter sodium chloride. The anode is suitably spaced apart from a steel screen cathode by a diaphragm drawn from an asbestos slurry. The cell is operated at an anode current density of 0.5 amp per square inch and a voltage of 2.8 volts. The sodium hydroxide concentration in the catholyte is about 90 grams per liter and the pH of the anolyte is from about 1.35 to about 4.35. The cell is operated at a temperature of from about 75° to about 85° C. Substantially no carbon dioxide from chemical attack of the graphite anode is formed during operation.

Example 4

The electrode produced in Example 1 is employed as an anode in a laboratory electrolytic cell to produce gaseous chlorine from an aqueous solution containing about 300 grams per liter sodium chloride. The anode is suitably spaced apart from a steel screen cathode by a diaphragm drawn from an asbestos slurry. The cell is operated at an anode current density of 1.25 amp per square inch and a voltage of 3.7 volts. The sodium hydroxide concentration in the catholyte is about 160 grams per liter and the pH of the anolyte is from about 2.0 to about 4.5. The cell is operated at a temperature of from about 75° to about 85° C. Substantially no carbon dioxide from chemical attack of the graphite anode is formed during operation.

What is claimed is:

1. An electrode comprising:

an electroconductive graphite substrate with at least a portion of the surface thereof being a solderable metal;

said electroconductive substrate being abuttingly joined to a film-forming metal foil by non-ferrous metal soldering the solderable metal surface of said substrate to the inner surface of said film-forming metal foil;

said film-forming metal foil with at least the soldered portion of the inner surface thereof being a solderable metal, the outer surface of said film-forming metal foil corresponding to at least a portion of the working area of the electrode, at least a portion of said outer surface being electrocatalytically active.

2. The electrode of claim 1 wherein the solderable metal is selected from the group consisting of iron, copper, nickel, lead, tin, zinc, aluminum, magnesium and alloys thereof.

3. The electrode of claim 1 wherein the solderable metal is copper.

4. The electrode of claim 1 wherein the film-forming metal is selected from the group consisting of titanium, tantalum, zirconium, molybdenum, niobium, hafnium, vanadium, tungsten, bismuth, aluminum, and alloys containing such metals.

5. The electrode of claim 1 wherein the film-forming metal is titanium.

6. The electrode of claim 1 wherein the electrocatalytically active surface of the film-forming metal contains at least one material selected from the group consisting of cobalt, platinum, iridium, osmium, palladium, rhodium, ruthenium, alloys containing such material, and compounds containing such material.

7. The electrode of claim 1 wherein the non-ferrous solder is selected from the group consisting of alloys of lead, tin, silver, bismuth, antimony, copper, zinc, and cadmium.

8. The electrode of claim 1 wherein the electrode is substantially fluid impervious.

9. The electrode of claim 1 wherein the electroconductive substrate is entirely surrounded by said film-forming metal.

10. In an electrolytic cell having an anode, the improved cell wherein the anode comprises the electrode of claim 1.

11. A method of producing an electrode comprising:

(a) interposing a non-ferrous filler layer between solderable metal surfaces of an electroconductive graphite substrate and a film-forming metal, the outer surface of said film-forming metal corresponding to at least a portion of the working area of the electrode, at least a portion of said outer surface being electrocatalytically active or capable of being rendered electrocatalytically active; and (b) heating at least said non-ferrous filler layer to a sufficient temperature to effect an electrically conductive soldered bond between said solderable metal surfaces.

12. A method of producing an electrode comprising:

(a) metal spraying a solderable metal onto at least a portion of the surface of an electroconductive graphite substrate;

(b) metal spraying a solderable metal onto at least a portion of the inner surface of a film-forming metal, the outer surface of the film-forming metal corresponding to at least a portion of the working area of the electrode, at least a portion of the outer surface being electrocatalytically active or capable of being rendered electrocatalytically active;

(c) interposing a non-ferrous filler layer between the surfaces of the graphite and the film-forming metal with the solderable metal applied thereto; and (d) heating at least the non-ferrous filler layer to a sufficient temperature to effect an electrically conductive soldered bond between the solderable metals.

13. The method of claim 12 wherein the solderable metal is applied to the electroconductive substrate by mmtal flame spraying.

14. A method of producing an anode for use in an electrolyte cell comprising:

(a) applying a copper coating to at least a portion of the surface of a graphite substrate;

(b) applying a copper coating to the inner surface of a sheet of titanium, the outer surface of said titanium sheet corresponding to at least a portion of the working area of the anode, at least a portion of said outer surface being electrocatalytically active or capable of being rendered electrocatalytically active;

(c) interposing a suitable solder between the copper coated surfaces of said graphite and said titanium; and (d) heating the solder to a sufficient temperature to form an electrically conductive bond between the copper coated surfaces of said graphite and said titanium.

15. In a process for electrolyzing an aqueous alkali metal chloride electrolyte by passing a direct electric current through the electrolyte and between a cathode and an anode; the improvement wherein the anode comprises the electrode of claim 1.

16. A composite structure suitable for use as an electrode in an electrolytic cell for electrolyzing an aqueous alkali metal chloride solution comprising;

an electroconductive substrate of substantially rectangular cross-section with at least a portion of the substrate being a solderable metal;

a film-forming metal with an electrocatalytically active surface portion being abuttingly joined to the substrate by means of an electrically conductive fused, non-ferrous bonding layer interposed between the solderable metal surfaces of the substrate and the film-forming metal, that portion of the film-forming metal extending beyond the edges of the substrate being bent inwardly toward the substrate; and a chemically resistant, organic material interposed between the bent portions of the film-forming metal and the substrate to provide a substantially fluid impervious electrode.

17. The composite structure of claim 16 wherein the substrate is graphite.

18. The composite structure of claim 17 wherein film-forming metal foil is soldered with a non-ferrous metal to the graphite, the soldered surface portions of the foil and the graphite being coated with a solderable metal by flame spraying.

* * * * *

UNITED STATES PATENT AND TRADEMARK OFFICE

CERTIFICATE OF CORRECTION

PATENT NO. : 4,181,585

DATED : January 1, 1980

INVENTOR(S) : Robert J. Pangborn

It is certified that error appears in the above-identified patent and that said Letters Patent are hereby corrected as shown below:

In the Abstract, line 2, delete the word "dissolved" and insert --disclosed--.

Col. 2, line 17, insert the word --a-- before the word "sufficient".

Col. 8, Claim 13, line 57, delete "mmtal" and insert the word --metal--.

Col. 8, Claim 14, line 59, delete the word "electrolyte" and insert --electrolytic--.

Signed and Sealed this

*Thirteenth* Day of *May 1980*

[SEAL]

*Attest:*

SIDNEY A. DIAMOND

*Attesting Officer*

*Commissioner of Patents and Trademarks*